US005573048A

United States Patent [19]

Moon et al.

[11] Patent Number: 5,573,048

[45] Date of Patent: Nov. 12, 1996

[54] LIQUID FILLING DEVICE AND METHOD

[75] Inventors: Jonathan E. Moon, Greensboro, N.C.; Karl E. Zemlin, Richmond, Ind.; Richard R. Hadgkiss, Greensboro, N.C.

[73] Assignee: ABCO Automation, Inc., Browns Summit, N.C.

[21] Appl. No.: 349,241

[22] Filed: Dec. 5, 1994

[51] Int. Cl.[6] ..... B65B 1/04; B65B 3/00

[52] U.S. Cl. ..... 141/370; 141/18; 141/114; 141/166; 141/173; 141/281; 141/313; 141/301; 53/300; 406/86

[58] Field of Search ..... 141/18, 114, 156, 141/157, 159, 160, 165–168, 173, 263–265, 269, 281, 284, 313, 369, 370, 372, 285, 44, 65, 51, 39, 40, 47, 54, 301, 302; 53/300; 406/86, 88–90; 137/588

[56] References Cited

U.S. PATENT DOCUMENTS

| | | | |
|---|---|---|---|
| 4,283,901 | 8/1981 | Schieser et al. | 53/300 |
| 4,369,898 | 1/1983 | Andersson | 222/4 |
| 4,386,636 | 6/1983 | Ellert | 141/114 |
| 4,676,285 | 6/1987 | Schieser et al. | 141/313 |
| 4,911,212 | 3/1990 | Burton | 141/369 |
| 5,145,008 | 9/1992 | Yun | 141/39 |

*Primary Examiner*—Henry J. Recla
*Assistant Examiner*—Steven O. Douglas

[57] ABSTRACT

Filling apparatus and method of operation are provided for rapid, selectively controlled filling of flexible, plastic, webbed containers with a liquid. The apparatus includes a cutter which separates the lead container from the web whereupon a shuttle delivers the separated container to a filling head. The filling head rapidly loads the container with the desired liquid whereupon the container is thereafter directed from the filling head along a specially constructed air table. Programmable controlls allow precise movement of the container handling and filling operation to ensure rapid and efficient container loading.

23 Claims, 5 Drawing Sheets

LIQUID FILLING DEVICE AND METHOD

BACKGROUND OF THE INVENTION

1. Field of the Invention

The invention herein pertains to a filling apparatus; particularly to apparatus for liquid loading of webbed flexible containers as are used by the beverage industry.

2. Description of the Prior Art and Objectives of The Invention

In recent years soft drink beverage manufacturers and others have felt the necessity of improving their production and packaging operations. One improvement of recent importance has been the development of flexible plastic webbed containers typically of rectangular shape which come in various sizes such as two and one half (2½) and five (5) gallon volumes for soda fountain syrup usage. These flexible containers are shipped in a continuous webb to soft drink bottlers who then fill the containers, separate them and ship them to distributors and the like. Conventional filling methods have been somewhat unsatisfactory because of their slow operating speeds due mainly to the extensive use of air cylinders to control the motion of the various mechanisms incorporated in conventional filling stations. Also a slight misalignment of any of the filling equipment can cause delays and downtime of the entire filling line. In addition, prior art filling stations have separated the containers from the web both before and after filling. Container separation after filling can sometimes be disadvantageous in that filled containers are heavy and bulky and may be damaged during separation. Likewise, containers loaded with liquid are difficult to align or realign on a conveyer or other means used to transport them from the filling operation for packaging and handling purposes.

Thus with the problems and disadvantages associated with prior art filling devices, the present invention was conceived and one of its objectives is to provide a high operating speed apparatus for rapidly and efficiently filling containers of the webbed or continuous type.

It is also an objective of the present invention to provide programmable servo-motor controllers to allow precise, accurate, and quick movement of the filling head and associated members.

It is another objective of the present invention to provide a main programmable controller to regulate the operation of the filling apparatus including the programmable servo-motor controllers.

It is yet another objective of the present invention to provide filling apparatus which utilizes an air table having a shallow gutter-like configuration which self-aligns the containers lengthwise along the path of travel for ease and simplicity in conveying loaded containers in automated systems.

It is yet still another objective of the present invention to provide a filling head which includes a fluid conduit which is resiliently biased to prevent liquid flow while efficiently eliminating gasses from the container prior to filling.

Various other objectives and advantages of the present invention will become apparent to those skilled in the art as a more detailed description is set forth below.

SUMMARY OF THE INVENTION

Apparatus is provided for liquid loading of fluid containers with liquid concentrations of soft drink beverage syrup or the like. The apparatus includes a frame which may be formed of stainless steel tubing or the like for receiving conventional webbed containers. Various sensors, servo-motor controls, movable members, and functions of the apparatus are electrically controlled by a main programmable controller. The main programmable controller includes a microprocessor, memory, and a computer interface. Operating programs are loaded from a computer through the interface and into the main programmable controller. The containers are guided along the frame whereupon the lead container is separated from the web by a container separator. The separated container is then urged by a shuttle to a servo-motor driven filling head. A means is provided to hold the container in place beneath the filling head whereupon the main programmable controller directs a spout-cap gripper to lift the spout and cap combination from the container. The main programmable controller directs the motion and actions of the filling head and spout-cap gripper by communicating with programmable servo-motor controllers that precisely control the servo-motors that drive the filling head shaft. The filling head then drops onto and seals against the container spout protrusion opening. Gasses are evacuated from the container through a fluid conduit in the filling head and thereafter, the fluid conduit is elevated within the filling head to allow liquid such as a beverage syrup to be forced through the filling head into the container. Once the filling or loading cycle is complete, the filling head lifts and the spout-cap gripper timely reinserts the spout and cap into the container. Thereafter the container is released onto a shallow gutter-like shaped air table therebelow which allows the substantially rectangularly shaped liquid filled container to center itself on the air table as it moves from the frame. One or more air tables may be utilized depending on the exact direction and auxiliary handling apparatus utilized. The liquid filled containers are then appropriately packaged for transportation to distributors or users.

DETAILED DESCRIPTION OF THE PREFERRED EMBODIMENTS AND OPERATION OF THE INVENTION

Figure 3:
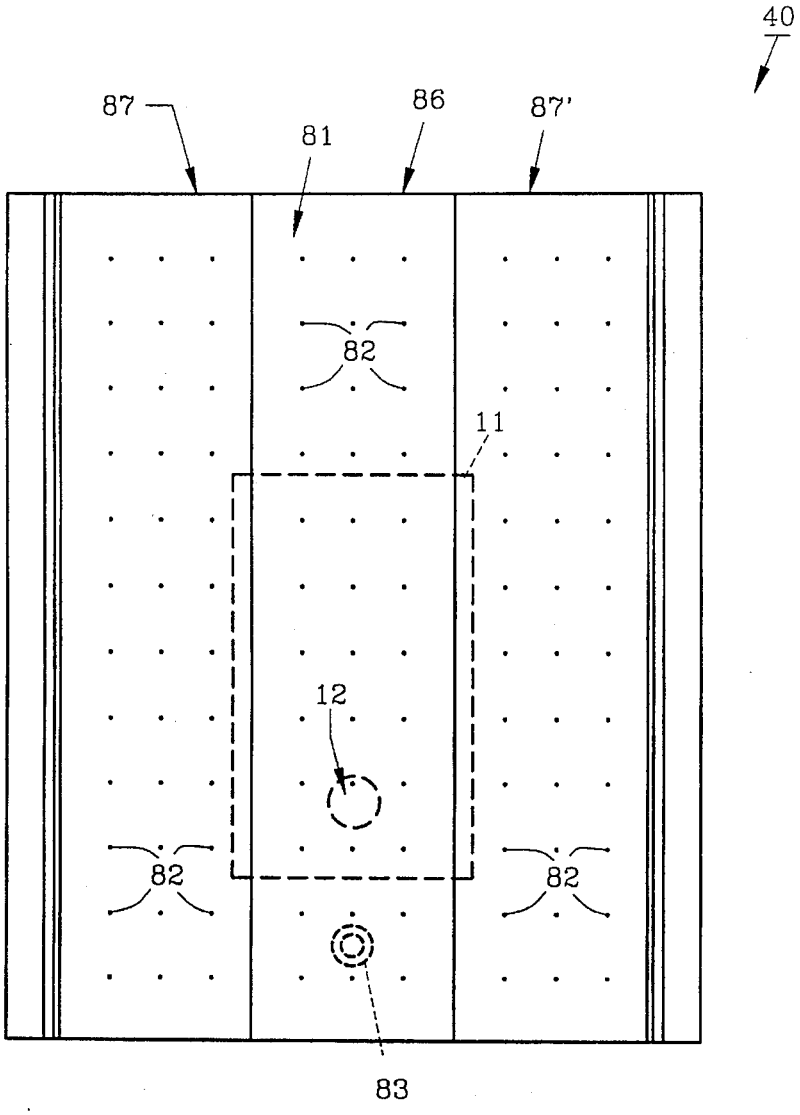
FIG. 3 depicts a top plan view of an air table.
Figure 3A:
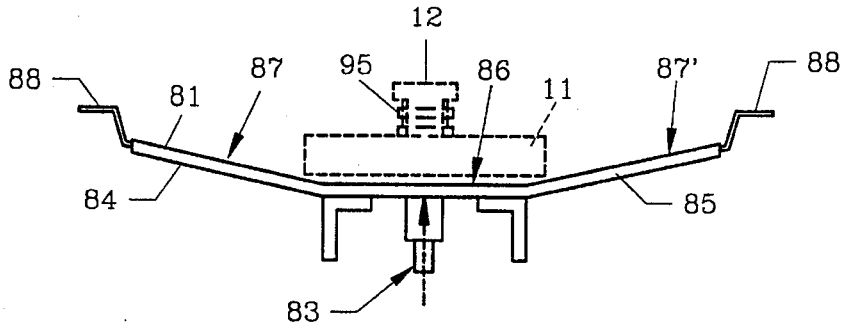
FIG. 3A demonstrates an end cross-sectional view of the air table as shown in FIG. 3.
Figure 4:
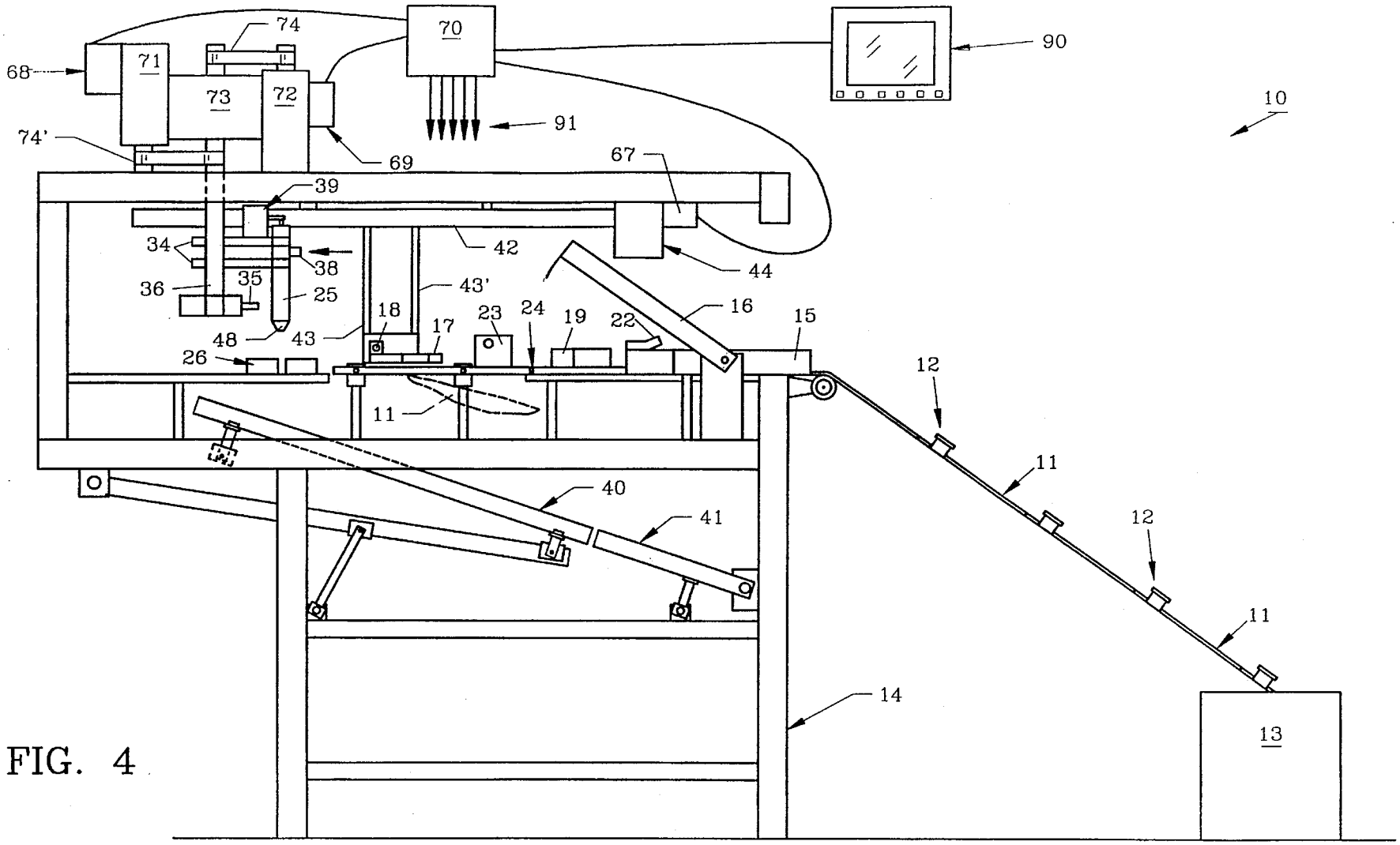
FIG. 4 features a side elevational view of the filling apparatus with webbed containers being fed therein.
Figure 5:
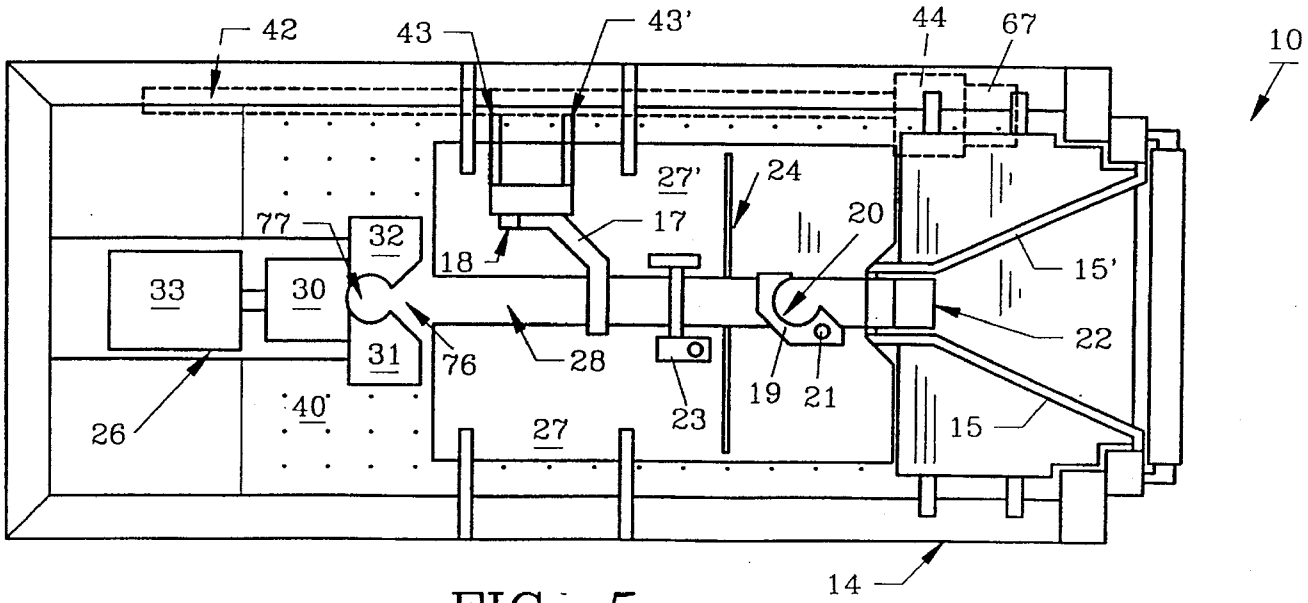
FIG. 5 shows a schematic top planar view of the filling apparatus as shown in FIG. 4 with the cutter, the filling head, the servo-motors and other components removed for clarity.

For a better understanding of the invention and its method of operation, turning now to the drawings, FIG. 4 illustrates a side view of prefered filling apparatus 10 for loading containers 11 which are supplied in webbed (connected) fashion and may consist of five (5) gallon polyethylene bags having a removable spout and cap 12 which is received in spout protrusion 95 which has a large top outside diameter and a small middle outside diameter (FIG. 3A), as is conventional in the beverage industry. As would be understood, containers 11 are supplied in compact fashion and are stored and transported in bins or boxes 13. Containers 11 may vary in size and are generally rectangular in shape and can be loaded with soft drink syrups or mixtures as conventional in the beverage industry. Filling apparatus 10 includes frame 14 to which are attached side guide members 15, 15' and top guide member 22 as shown in FIG. 5. Container spout protrusion 95 is then guided into slot 28 between planar horizontal members 27, 27'. As shown in FIG. 5, container spout holder 19 has an arcuate inner gripping surface 20 which is approximately 185 degrees to thus prevent the container spout from inadvertantly dislodging. As further shown in FIG. 5, spout holder 19 is pivotally movable around axis 21 to release container spout protrusion 95 and spout and cap combination 12 as shuttle 17 moves from right to left. Shuttle 17 is movably affixed along frame 14 and is vertically pivotable along axis shuttle pivot 18 to bypass spout and cap combination 12 and spout protrusion 95 of containers 11. Shuttle 17 is movably affixed to shuttle track 42 by shuttle supports 43, 43' and is driven along track 42 by servo-motor 44. Shuttle ramp 23 forces shuttle 17 to pivot vertically upwardly as shuttle 17 moves from left to right. Shuttle ramp 23 is pivotally mounted to allow shuttle 17 to move spout protrusion 95 of container 11 from right to left without the motion of spout protrusion 95 being disturbed by shuttle ramp 23. When containers 11 are moved from right to left by shuttle 17, away from holder 19 container separator 16 which is pivotally joined to frame 14 operates in a timed sequence to separate containers 11 at separator slot 24.

Once container 11 is separated by container separator 16 from its adjacent container, shuttle 17 drags container 11 by spout protrusion 95 into position beneath liquid filling head 25 as shown in FIG. 4. Filling head 25, as will be hereinafter more fully explained, delivers a liquid such as a soft drink mixture or otherwise into containers 11. Shuttle 17 drags separated container 11 into spout protrusion holder 26 along horizontal planar members 27, 27' which form slot 28 therebetween. Spout protrusion 95 of container 11 extends above horizontal planar members 27, 27' through slot 28. Slot 28 is of a width less than the large top outside diameter of spout protrusion 95, but larger than the small middle outside diameter of the spout protrusion 95 as seen in FIG. 3A.

Figure 7:
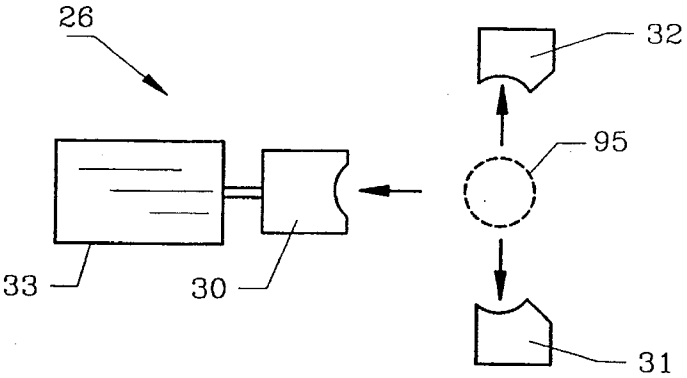
FIG. 7 pictures a schematic representation of the spout holder in an open posture.

Spout protrusion holder 26 comprises jaws 30, 31, and 32 shown schematically in FIG. 7 and are mechanically joined and biased closed as in FIG. 5. Shuttle 17 pushes spout protrusion 95 from slot 28 and into triangular spout holder entrance 76 of spout holder 26. By pushing spout protrusion 95 through spout holder entrance 76, shuttle 17 forces jaws 30 and 31 a sufficient distance apart to allow spout protrusion 95 to enter spout holder opening 77, and is locked into position by jaws 30, 31, and 32 for filling, as shuttle 17 retracts. When container 11 has been filled and recapped, air cylinder 33 contracts, and spout protrusion holder 26 opens by separating jaws 30, 31, and 32 as in FIG. 7, thereby releasing filled container 11 onto air table 40.

Figure 2A:
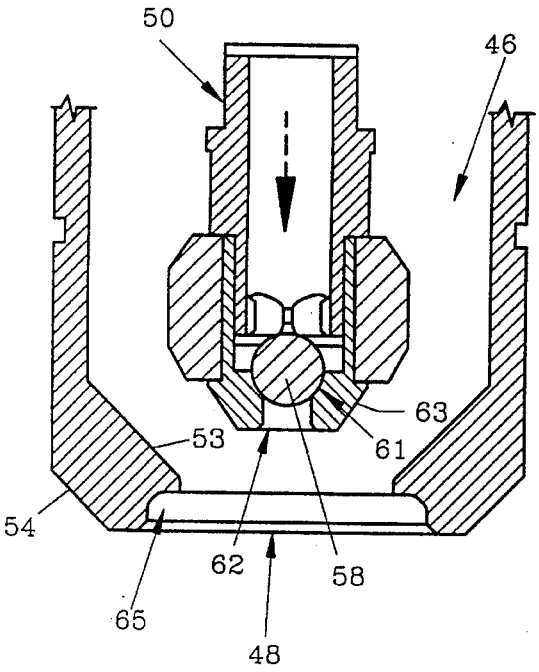
FIG. 2A illustrates an enlarged cross-sectional view of the lower section of the filler head of FIG. 2.

Once container spout protrusion 95 is "locked" into spout protrusion holder 26, spout-cap gripper 35 pivotally moves to remove spout and cap 12 upwardly therefrom. Spout protrusion 95 just vacated by spout and cap 12 is then utilized by filling head 25. Filling head 25 is of a diameter so that it receives and seals spout protrusion 95 thereby forming a seal with container 11. Filling head 25 then evacuates gasses from container 11 by applying a vacuum. The vacuum is then terminated at which point liquid is pumped through filling head 25 into container 11 by retracting fluid conduit 50 as in FIGS. 2 and 2A. Once the desired preset amount of liquid has been loaded, fluid conduit 50 is returned to its normally biased closed position to terminate loading. Filling head 25 is raised and pivots simultaneously with the return pivoting action of spout-cap gripper 35 which quickly reinserts spout and cap combination 12 into the spout protrusion 95 of container 11. As understood by those in the beverage container industry, spout and cap combinations 12 are received from the container manufacturer temporarily inserted into spout protrusions 95 of containers 11 for easy removal by spout-cap gripper 35. Once containers 11 are filled, spout-cap gripper 35 then strongly urges spout and cap combination 12 into spout protrusion 95, thus forming a permanent seal and allowing liquid removal from container 11 by users who remove the cap of spout and cap combination 12 from the spout.

After filling, and spout and cap combination 12 reinsertion into container 11, spout holder 26 opens allowing loaded container 11 to pass downwardly along first air table 40. Air table 40 is pivotally connected to frame 14 as shown in FIG. 4 and may be positioned contiguous to second air table 41 as also shown in FIG. 4. Air tables 40 and 41 may then direct filled liquid containers 11 from frame 14 to a conveyer or to other container handling equipment.

Figure 6:
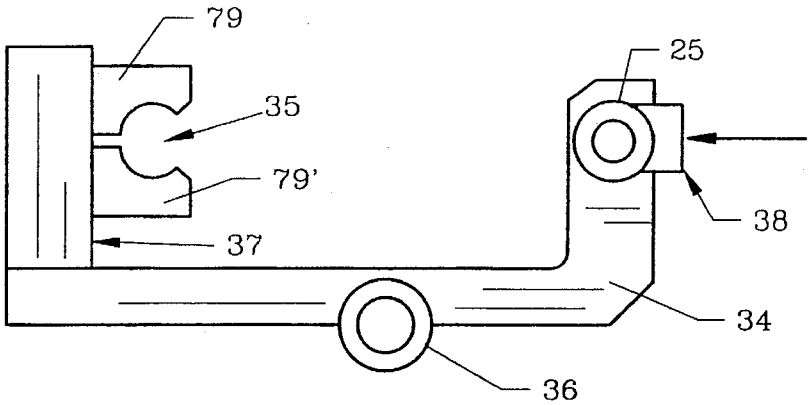
FIG. 6 depicts an enlarged bottom planar view of the filling head shaft, filling head, spout-cap gripper, supporting brackets and certain other components.

In FIG. 6 spout-cap gripper 35 is shown joined to filling head shaft 36 by arm 34 and cap gripper bracket 37. Jaws 79 and 79' of cap-spout gripper 35 open and close to hold spout and cap 12. Filling head 25 is attached to filling head shaft 36 by L-shaped arms 34, 34' (FIG.4). Liquid inlet 38 of filling head 25 is connected to a hose or other means (not shown) for supplying liquid thereto.

As illustrated in FIGS. 4, 5, 6, and 7, the preferred method of filling webbed containers 11 includes directing webbed containers 11 to filling apparatus 10, and separating the lead container by container separator 16 from the web. Thereafter, the lead container is moved by shuttle 17 to filling head 25 where spout and cap combination 12 are removed by servo-motor controlled spout-cap gripper 35. Next, filling head 25 moves into position to fill containers 11 which are then released after they have been filled and recapped and move along air table 40 to conventional liquid filled container handling equipment (not shown).

Figure 1A:
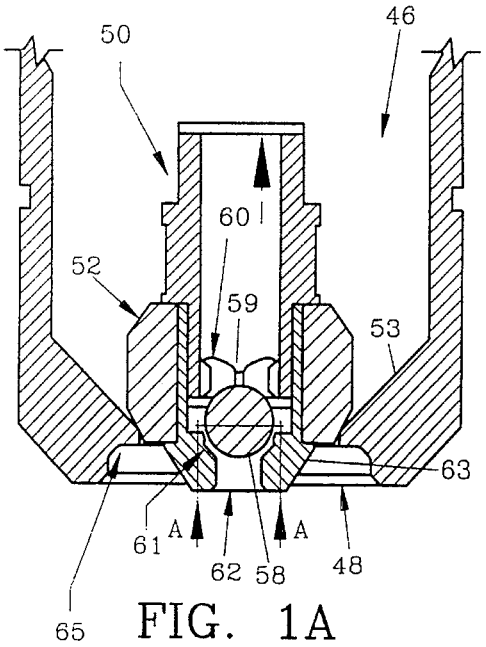
FIG. 1A shows an enlarged cross-sectional view of the lower section of the filler head of FIG. 1.
Figure 1:
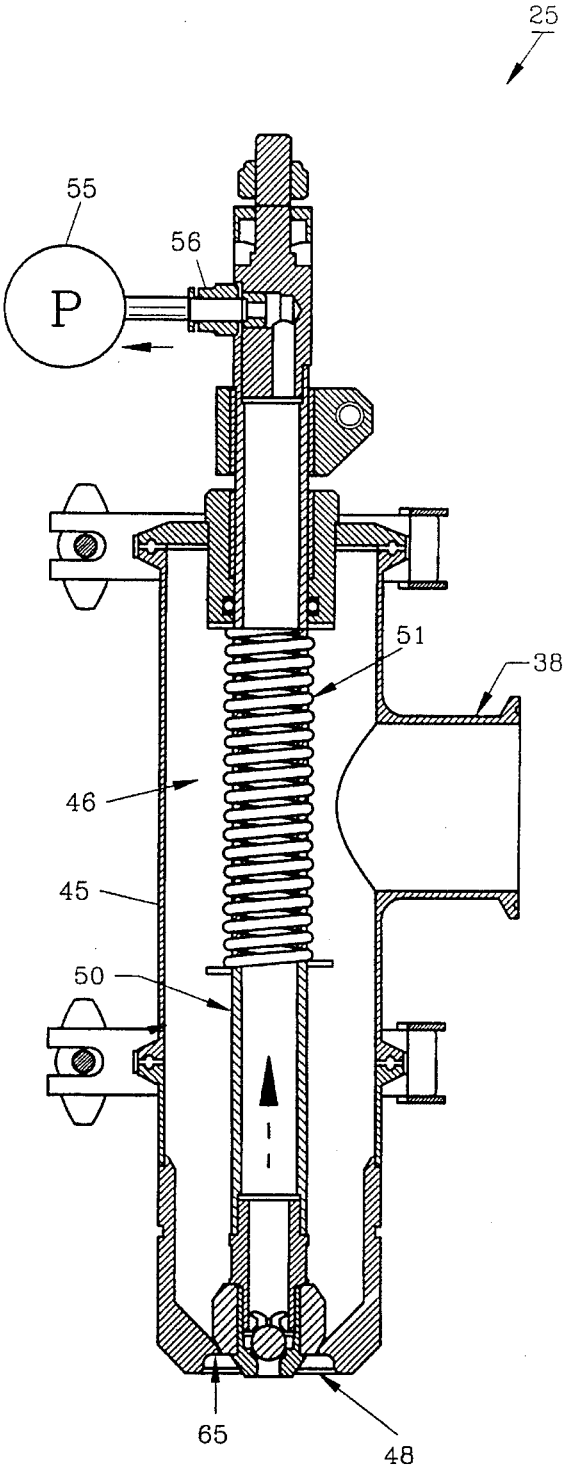
FIG. 1 illustrates a cross-sectional view of the filler head used to load the containers herein with a vacuum applied to the fluid conduit which is in a down or closed posture with the ball valve in an up or open position.
Figure 1B:
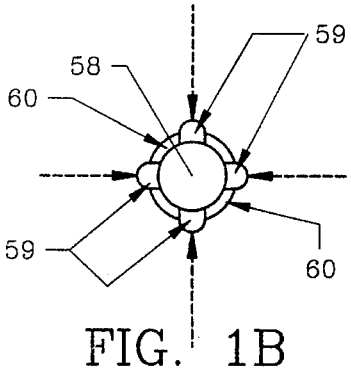
FIG. 1B demonstrates a schematic bottom view along lines A—A of FIG. 1A showing the openings around the ball that allow upward passage of fluids when a vacuum is applied.
Figure 2:
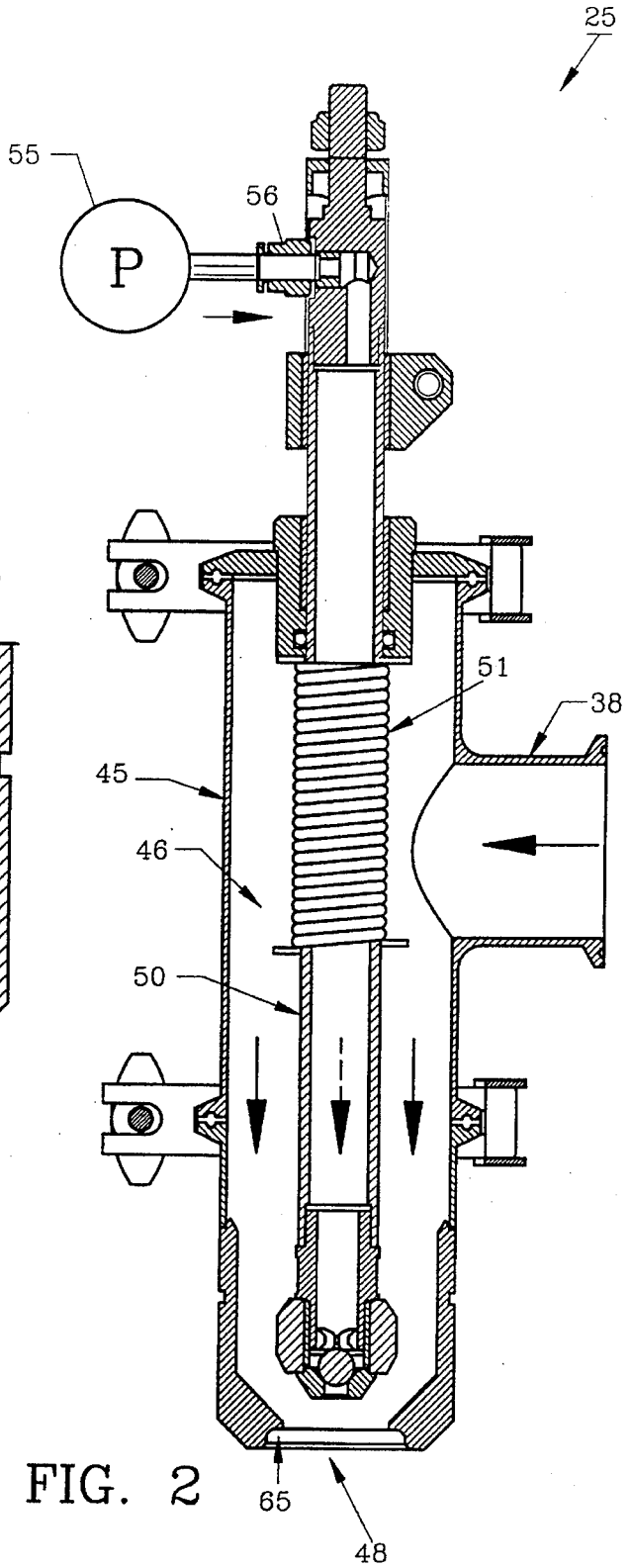
FIG. 2 pictures a cross-sectional view of the filling head as seen in FIG. 1 with a positive air pressure applied to the fluid conduit in an elevated or opened posture with the ball valve in a downward or closed position.

Preferred liquid filling head 25 is shown in FIGS. 1 and 2 in two different modes. Filling head 25 includes tubular body portion 45 having hollow interior 46. Thus, liquid entering liquid inlet 38 passes through interior 46 of tubular body portion 45 and exits through nozzle 48 as shown in FIG. 2. Movable fluid conduit 50 is also contained within body portion 45 and is biased downwardly towards nozzle 48 by resilient member 51 as shown in FIG. 1. Resilient member 51 may consist of a stainless steel coil spring which, when relaxed, closes nozzle 48 from interior 46 with fluid conduit 50 as shown in FIG. 1A. Fluid conduit end 52 contacts nozzle interior wall 53 as shown in FIG. 1A. In the posture as illustrated in FIG. 1, liquid entering from liquid receiving port 38 is blocked and cannot escape filling head 25. Pump 55 which is reversible to provide both a vacuum and positive air pressure to fluid conduit 50 is in fluid communication therewith through inlet 56. Thus, as would be understood, with resilient member 51 relaxed fluid conduit 50 is in a downward posture as shown in FIG. 1 and liquid contained within interior 46 of tubular body portion 45 is captured therein. With vacuum pressure applied by pump 55 to fluid conduit 50, valve ball 58 lifts to allow air and other fluid contaminants as may be found in container 11 to be evacuated therefrom as shown in FIGS. 1A and 1B. In FIG. 1B, taken along lines A—A of FIG. 1A, it can be seen that openings 59 are contained with an upper ball seat 60 and as shown, valve ball 58 only partially closes openings 59 thus allowing fluids to pass upwardly around valve ball 58 and through openings 59, towards pump 55.

Lower ball valve seat 61 allows ball 58 to close port 62 and tip 63 from fluid communication with fluid conduit 50. Ball 58 is closed against lower ball valve seat 61 by positive air pressure applied by pump 55. Thus when fluid conduit 50 is in a raised position during filling, as liquid passes through nozzle 48 into containers 11, positive pressure within fluid conduit 50 prevents liquid from entering fluid conduit 50. Fluid conduit 50 is raised upwardly from its normally closed position by filling head air cylinder 39 as shown in FIG. 4. As earlier explained, filling head 25 is connected to filling head shaft 36 which provides both vertical and rotational movement as shown in FIGS. 4 and 6 for controlling the needed vertical and lateral rotational movement of filling head 25 for insertion onto container 11.

Container spout protrusion 95 is receivable within spout receiving recess 65 of nozzle 48 (FIG. 1). Spout receiving recess 65 is of a diameter and depth that allows container 11 to be sealed as spout protrusion 95 is seated within recess 65.

The overall operation speed of the apparatus is improved by the use of servo-motors 44, 71, and 72. Servo-motors 44, 71, and 72 are respectively connected to and controlled by programmable servo-motor controllers 67, 68, and 69 as seen in FIG. 4.

Servo-motors 44, 71, and 72 and programmable servo-motor controllers 67, 68, and 69 are a brushless servo-system with a closed loop control and a resolver feedback such as controller Model SC-753 and servo-motor Model R45-GM sold by Pacific Scientific of Rockford, Ill. Servo-motors 44, 71, and 72 and programmable servo-motor controllers 67, 68, and 69 have digital control, autotuning and single resolver feedback that provide closed loop torque, velocity, and position control. Computer programs are downloaded from a computer into programmable servo-motor controllers 67, 68, and 69 where they are stored and utilized in the controlling of servo-motors 44, 71, and 72.

Servo-motors 44, 71, and 72 in conjunction with servo-motor controllers 67, 68, and 69 allow for the high speed and accurate movements of shuttle 17, filling head shaft 36, filling head 25, and spout-cap gripper 35. Servo-motor controllers 67, 68, and 69 provide precise and accurate control of speed, acceleration, deceleration, and torque of shuttle 17, filling head shaft 36, filling head 25, and spout-cap gripper 35. Servo-motors 71 and 72 are connected to filling head shaft 36 by actuator 73 and drive belts 74 and 74' respectively. Servo-motor controllers 67, 68, and 69 are connected to and directed through electrical communications with main programmable controller 70.

Main programmable controller 70 is in electrical communications with control panel 90 as in FIG. 4. Programmable controller 70 comprises a microprocessor, memory, computer interface and other conventional hardware that allows the operator (with suitable programs in place) to control the servo-motor driven components of filling apparatus 10. Operating programs are downloaded and modified from a computer through the interface and into the main programmable controller 70. Programmable controller 70 automatically operates filling apparatus 10 by communicating with and sensing the electronic and mechanical elements of apparatus 10. Programmable controller 70 coordinates and controls the functions of apparatus 10 including the movements of containers 11, separating thereof, and opening and closing of valves and holders of apparatus 11 based on information gathered from sensors such as strategically placed conventional photo-eyes and proximity switches (not shown). Wires 90 are connected to various components of apparatus I0 but have been fragmented in FIG. 4 for clarity. Containers 11 as seen in FIG. 4 may be as hereinbefore mentioned, varied in size and shape, thus programmable controller 70 can be used for rapid adjustment of operating parameters under rigid and varied production conditions and requirements.

As also hereinbefore explained, after filling of containers 11 has been completed and spout and cap combinations 12 have been reinserted, containers 11 are released and are directed from filling head 25 to preferred air table 40 positioned therebelow. Air table 40 as seen in FIG. 3 has a top surface 81 defining a plurality of apertures 82 thereal-ong. Pressurized air is supplied from a conventional air compressor or the like (not seen) through inlet 83 shown in FIG. 3A which is joined to bottom surface 84. Air table 40 includes cavity 85 between upper surface 81 and lower surface 84. Air passes through cavity 85 under positive pressure and exits apertures 82 to "float" filled containers such as container 11 seen in ghost fashion in FIG. 3 and 3A thereon.

Empty containers 11 may have a length of, for example, 19 inches and a width of, for example, 14 inches. It is important that containers 11, when filled move in a properly aligned fashion along air table 40 for subsequent efficient automated handling, packaging and the like. Thus, in order to ensure correct and efficient movement, air table 40 has been designed with a somewhat shallow, gutter-like shape as shown in FIG. 3A with a flat horizontal central portion 86 which is connected to slanted side portions 87, 87'. Side rails 88, 88' which are solid are also shown joined respectively to side portions 87, 87' to assist in controlling larger containers. By slanting side portions 87, 87' upwardly, container 11 as seen in FIG. 3 and 3A will "center" and self-align, thereby providing a consistent delivery position of containers 11 as they exit air table 40. Air table 40 is most effective at aligning rectangular shapes which have a length greater than the width of the flat horizontal central portion 86. A rectangular bag having a length greater than the width of the flat horizontal central portion 86, will be aligned so that its longer length runs coincidently with the length of air table 40, which is the intended travel direction of loaded container 11.

The illustrations, examples and methods provided herein are for explanatory purposes and are not intended to limit the scope of the appended claims.

We claim:

1. A liquid filling head comprising a tubular body portion, said tubular body portion having a bottom end, a nozzle, said nozzle joined to said bottom end of said tubular body portion, a liquid inlet, said liquid inlet communicating with the interior of said tubular body portion, a movable fluid conduit, said movable fluid conduit having a lower end, said fluid conduit disposed within said tubular body portion wherein said lower end of said fluid conduit is positioned proximate said nozzle, and a valve, said valve comprising a ball valve, said ball valve comprising an upper ball seat, said upper ball seat defining a plurality of openings, said openings communicating with said interior of said fluid conduit, said valve positioned proximate said lower end of said fluid conduit to control fluid movement therethrough.

2. The liquid filling head of claim 1 wherein said fluid conduit is movably positioned contiguous to said nozzle so said lower end of said fluid conduit closes the interior of said tubular body portion from said nozzle.

3. The liquid filling head of claim 1 and including a resilient member, said resilient member attached to said fluid conduit.

4. The liquid filling head of claim 3 wherein said resilient member biases said nozzle normally closed.

5. The liquid filling head of claim 1 wherein said ball valve comprises a lower ball seat.

6. Apparatus for filling webbed containers, said containers each having a spout and cap combination comprising: a frame, a horizontal member mounted on said frame, said horizontal member defining a slot for accepting and confining a spout of a container, a container separator for dividing said webbed containers, said container separator mounted to said frame, a shuttle, said shuttle for pushing said container spout along said slot, said shuttle movably mounted to said frame, means to hold a container during filling, said container holding means attached to said frame, a filling head, said filling head movably mounted on said frame, and a plurality of air tables, said air tables pivotally mounted to said frame and aligned below said container holding means, said air tables for receiving a filled container.

7. Apparatus of claim 6 and including a spout-cap gripper, said spout-cap gripper positioned on said frame, said spout-cap gripper for removing said spout and cap combination prior to container filling.

8. Apparatus of claim 6 wherein said filling head comprises a tubular body portion and a movable fluid conduit, and said movable fluid conduit positioned within said tubular body portion.

9. Apparatus of claim 6 and including a filling head drive mechanism, said drive mechanism comprising: first and second servo-motors, an actuator, said first and second servo-motors each joined to said actuator, a filling head shaft having an upper and a lower end, said upper end of said shaft coupled to said actuator, and said lower end connected to said filling head.

10. Apparatus of claim 6 wherein said air table comprises a top surface, said top surface having a flat portion and a slanted portion, said slanted portion for aligning filled containers on said top surface.

11. Apparatus of claim 6 and including a servo-motor, said servo-motor attached to said frame, and means for driving said shuttle, said drive means connected to said servo-motor.

12. A filling head drive mechanism comprising: first and second servo-motors, an actuator, said first and said second servo-motors each joined to said actuator for operating the same, a filling head shaft, said shaft coupled to said actuator, programmable controls, said programmable controls connected to said servo-motors for regulating the same, a filling head, said filling head comprising a tubular body portion, said tubular body portion having a bottom end, a nozzle, said nozzle joined to said bottom end of said tubular body portion, a liquid inlet, said liquid inlet communicating with the interior of said tubular body portion, a movable fluid conduit, said movable fluid conduit having a lower end, said fluid conduit disposed within said tubular body portion wherein said lower end of said fluid conduit is positioned proximate said nozzle, and a valve, said valve comprising a ball valve, said ball valve comprising an upper ball seat, said upper ball seat defining a plurality of openings, said opening communicating with said interior of said fluid conduit, said valve positioned proximate said lower end of said fluid conduit to control fluid movement therethrough.

13. The filling head drive mechanism of claim 12 wherein said shaft is movably coupled to said actuator.

14. The filling head drive mechanism of claim 12 wherein said programmable controls determine the speed of said servo-motors.

15. The filling head drive mechanism of claim 12 and including a filling head, said filling head attached to said filling head shaft.

16. The filling head drive mechanism of claim 12 and including a spout cap gripper, said spout cap gripper attached to said filling head shaft.

17. Apparatus for filling webbed containers, said containers each having a spout and cap combination comprising: a frame, a shuttle for moving a container along said frame, said shuttle movabley mounted to said frame, first and second servo-motors, said first servo-motor and said second servo-motor mounted to said frame, an actuator, said actuator joined to said first servo-motor and said second servo-motor, a filling head shaft having an upper and a lower end, said upper end of said shaft coupled to said actuator, a filling head, said filling head comprising a tubular body portion, said tubular body portion having a bottom end, a nozzle, said nozzle joined to said bottom end of said tubular body portion, a liquid inlet, said liquid inlet communicating with the interior of said tubular body portion, a movable fluid conduit, said movable fluid conduit having a lower end, said fluid conduit disposed within said tubular body portion wherein said lower end of said fluid conduit is positioned proximate said nozzle, and a valve, said valve positioned proximate said lower end of said fluid conduit to control fluid movement therethrough, said filling head connected to said lower end of said filling head shaft, and an air table, said air table for supporting a filled container, said air table having a top surface, said top surface having a flat portion and a slanted portion, said slanted portion for aligning filled containers on said air table top surface.

18. Apparatus of claim 17 including a third servo-motor, said third servo-motor for driving said shuttle, said third servo-motor mounted on said frame and connected to said shuttle.

19. Apparatus of claim 17 including a first and second programmable servo-motor controllers, said first programmable servo-motor controller electrically connected to said first servo-motor, and said second programmable servo-motor controller electrically connected to said second servo-motor for selectively controlling the same.

20. Apparatus of claim 19 including a main programmable controller, said main programmable controller electrically connected to said first and to said second servo-motor controllers for directing the same.

21. An air table for handling objects comprising: a top surface, a bottom surface, said top and said bottom surface forming a cavity therebetween, an inlet, said inlet in fluid communication with said cavity, said top surface defining a plurality of apertures, said apertures in fluid communication with said cavity whereby fluid entering said cavity through said inlet and exiting through said apertures will float an object above said top surface, said top surface having a somewhat gutter-like shape, a mounting bracket, said mounting bracket attached to said bottom surface, said top surface comprising a horizontal portion, and two slanted side portions, said horizontal portion positioned between said side portions, said horizontal portion having width less than the length of said object, whereby said object will be centered above said horizontal portion.

22. A method of filling containers comprising the steps of:

(a) directing a container to a filling station, (b) programming a servo-motor actuator to move a filling head into contact with the container, (c) filling the container with liquid from the filling head, (d) discharging the filled container from the filling head, and (e) self-aligning the discharged container on an air table, said air table comprising a top surface and a bottom surface, said top surface comprising a horizontal portion and two slanted side portions, said horizontal portions positioned between said side portions, said horizontal portion having width less than the length of said container so that said container is centered above said horizontal portion.

23. The method of claim 22 wherein filling the container with liquid comprises releasing the liquid into the container through said filling head, said filling head defining a hollow interior, said filling head comprising a fluid conduit, said fluid conduit positioned within said hollow interior, said fluid conduit selectively movable between an open position and a closed position, a resilient member, said resilient member positioned on said fluid conduit whereby said resilient member biases said fluid conduit into said closed position such that said liquid is prevented from filling said container.

* * * * *